US011746978B2

(12) United States Patent
Jin

(10) Patent No.: US 11,746,978 B2
(45) Date of Patent: Sep. 5, 2023

(54) LAMP FOR VEHICLE AND VEHICLE INCLUDING THE SAME

(71) Applicant: HYUNDAI MOBIS CO., LTD., Seoul (KR)

(72) Inventor: Min Ji Jin, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/862,467

(22) Filed: Jul. 12, 2022

(65) Prior Publication Data

US 2023/0139526 A1 May 4, 2023

(30) Foreign Application Priority Data

Oct. 28, 2021 (KR) ..... 10-2021-0145512

(51) Int. Cl.

| | |
|---|---|
| ***F21S 41/265*** | (2018.01) |
| ***F21S 41/24*** | (2018.01) |
| ***F21S 41/148*** | (2018.01) |
| ***F21S 41/33*** | (2018.01) |
| ***F21S 41/26*** | (2018.01) |

(52) U.S. Cl.

CPC ..... *F21S 41/265* (2018.01); *F21S 41/148* (2018.01); *F21S 41/24* (2018.01); *F21S 41/26* (2018.01); *F21S 41/336* (2018.01)

(58) Field of Classification Search

CPC ..... F21S 41/265; F21S 41/24; F21S 41/27; F21S 41/26; F21S 41/148; F21S 41/336; F21V 5/08

See application file for complete search history.

(56) References Cited

U.S. PATENT DOCUMENTS

| | | | | |
|---|---|---|---|---|
| 10,955,102 | B1 * | 3/2021 | Lee | F21S 41/151 |
| 11,655,951 | B2 * | 5/2023 | Lee | F21S 41/25 362/520 |
| 2014/0233253 | A1 * | 8/2014 | Owada | F21S 41/323 362/516 |
| 2016/0091159 | A1 * | 3/2016 | Puech | F21S 41/143 362/544 |
| 2017/0030543 | A1 * | 2/2017 | Gromfeld | F21S 41/322 |
| 2018/0058651 | A1 * | 3/2018 | Gromfeld | F21S 41/147 |

(Continued)

FOREIGN PATENT DOCUMENTS

DE 202020105338 U1 * 11/2020 ..... F21S 41/10

*Primary Examiner* — Erin Kryukova
(74) *Attorney, Agent, or Firm* — NovoTechIP International PLLC

(57) ABSTRACT

Disclosed is a lamp for a vehicle, the lamp including a light source unit including a plurality of light sources configured to emit light, and an inner lens configured to allow the light emitted from the light source unit to enter the inner lens, in which the inner lens includes a light entering surface configured to define a rear surface of the inner lens and allow the light emitted from the light source unit to enter the light entering surface, and a light exiting surface configured to define a front surface of the inner lens and allow the light entering the light entering surface to exit, and in which the light exiting surface has a curved shape curved so that positions on the light exiting surface from one side end to the other side end opposite to one side end based on a leftward/rightward direction W become closer to a rear side.

14 Claims, 6 Drawing Sheets

(56) References Cited

U.S. PATENT DOCUMENTS

| | | | | |
|---|---|---|---|---|
| 2022/0065419 | A1* | 3/2022 | Potter | F21S 41/20 |
| 2022/0099265 | A1* | 3/2022 | Lee | F21S 41/265 |
| 2023/0175663 | A1* | 6/2023 | Chen | F21S 41/26<br>362/520 |

* cited by examiner

LAMP FOR VEHICLE AND VEHICLE INCLUDING THE SAME

CROSS-REFERENCE TO RELATED APPLICATIONS

This application claims the benefit of priority to Korean Patent Application No. 10-2021-0145512 filed in the Korean Intellectual Property Office on Oct. 28, 2021, the entire content of which is incorporated herein by reference.

BACKGROUND

1. Technical Field

The present disclosure relates to a lamp for a vehicle and a vehicle including the same.

2. Discussion of Related Art

A lamp for a vehicle, which is configured to form a low-beam light distribution pattern, is required to have different luminous intensity magnitudes for respective regions of the low-beam light distribution pattern. More specifically, luminous intensity at a central portion (hot zone) of the low-beam light distribution pattern needs to be higher than luminous intensity at a peripheral portion (wide zone) of the low-beam light distribution pattern in order to comply with the regulations.

Studies are being conducted on a lamp for a vehicle having a single inner lens in order to implement the low-beam light distribution pattern. To this end, in the related art, the inner lens is designed to have different geometric shapes for respective regions of the inner lens. That is, in the related art, the inner lens mounted in the lamp for a vehicle for forming the low-beam light distribution pattern is designed such that a geometric shape of a region into which light, which is to reach the central portion of the low-beam light distribution pattern, is introduced is different from a geometric shape of a region into which light, which is to reach the peripheral portion of the low-beam light distribution pattern, is introduced.

However, in the related art, a boundary between the region into which the light, which is to reach the central portion of the low-beam light distribution pattern, is introduced and the region into which the light, which is to reach the peripheral portion of the low-beam light distribution pattern, is introduced, are discontinuously formed. For this problem, a discontinuous light distribution pattern is formed in a partial region of the low-beam light distribution pattern by light exiting through the boundary. This degrades the quality of the lamp.

SUMMARY

The present disclosure has been made in an effort to implement a continuous low-beam light distribution pattern as an inner lens of a lamp for a vehicle for forming a low-beam light distribution pattern has a continuous shape.

An aspect of the present disclosure provides a lamp for a vehicle, the lamp including: a light source unit including a plurality of light sources configured to emit light; and an inner lens configured to allow the light emitted from the light source unit to enter the inner lens, in which the inner lens includes: a light entering surface configured to define a rear surface of the inner lens and allow the light emitted from the light source unit to enter the light entering surface; and a light exiting surface configured to define a front surface of the inner lens and allow the light entering the light entering surface to exit, and in which the light exiting surface has a curved shape curved so that positions on the light exiting surface from one side end of the inner lens to the other side end of the inner lens opposite to one side end based on a leftward/rightward direction W become closer to a rear side.

The light entering surface may have a shape asymmetric in the leftward/rightward direction W.

A focal point of the inner lens in the leftward/rightward direction W and a focal point of the inner lens in an upward/downward direction H may be identical to each other.

An angle β defined between a forward/rearward direction F and an imaginary line connecting a vertex region A1 positioned at a rearmost side of the light entering surface and a region of the light entering surface positioned at one side end may be larger than an angle α defined between the forward/rearward direction F and an imaginary line connecting the vertex region A1 and a region of the light entering surface positioned at the other side end.

The vertex region A1 of the inner lens may be spaced apart from a focal point C of the inner lens toward the other side end based on the leftward/rightward direction W.

An interval between the plurality of light sources disposed adjacent to one side end of the inner lens based on the leftward/rightward direction W among the plurality of light sources of the light source unit may be larger than an interval between the plurality of light sources disposed adjacent to the other side end of the inner lens based on the leftward/rightward direction W among the plurality of light sources of the light source unit.

A light-emitting surface of the light source provided in a central region of the inner lens based on the leftward/rightward direction W among the plurality of light sources of the light source unit may be smaller than a light-emitting surface of the light source provided in a peripheral region of the inner lens based on the leftward/rightward direction W among the plurality of light sources of the light source unit.

The lamp may further include a reflector disposed at one side of the light source unit and configured to reflect the light emitted from the light source unit and allow the light to propagate toward the inner lens, and a shortest distance between a rear region of the reflector and the light source provided in a central region of the inner lens based on the leftward/rightward direction W among the plurality of light sources of the light source unit may be shorter than a shortest distance between the rear region of the reflector and the light source provided in a peripheral region of the inner lens based on the leftward/rightward direction W among the plurality of light sources of the light source unit.

A region of the light entering surface positioned at one side end based on the leftward/rightward direction W may be closer to a front side than is a region of the light entering surface positioned at the other side end based on the leftward/rightward direction W.

The light entering surface may have a shape convex rearward, and the light exiting surface may have a shape convex forward.

The lamp may further include a shield disposed between the light source unit and the inner lens and having a cut-off portion having a stepped shape, and a focal point C of the inner lens may be provided at a position corresponding to a front end of the shield.

Another aspect of the present disclosure provides a vehicle including: a lamp for a vehicle, in which the lamp includes: a light source unit including a plurality of light sources configured to emit light; and an inner lens configured to allow the light emitted from the light source unit to enter the inner lens, in which the inner lens includes: a light entering surface configured to define a rear surface of the inner lens and allow the light emitted from the light source unit to enter the light entering surface; and a light exiting surface configured to define a front surface of the inner lens and allow the light entering the light entering surface to exit, and in which the light exiting surface has a curved shape curved so that positions on the light exiting surface from one side end to the other side end opposite to one side end based on a leftward/rightward direction W become closer to a rear side.

One side end based on the leftward/rightward direction W may be disposed adjacent to a central region of the vehicle, and the other side end based on the leftward/rightward direction W may be disposed adjacent to an outer region of the vehicle.

According to the present disclosure, it is possible to implement a continuous low-beam light distribution pattern as the inner lens of the lamp for a vehicle for forming a low-beam light distribution pattern has a continuous shape.

BRIEF DESCRIPTION OF THE DRAWINGS

FIG. 4 is a view illustrating a light distribution pattern formed when light sources provided in a central region of the lamp for a vehicle according to the present disclosure based on a leftward/rightward direction are turned on.

FIG. 5 is a view illustrating a light distribution pattern formed when light sources provided in a peripheral region of the lamp for a vehicle according to the present disclosure based on the leftward/rightward direction are turned on.

FIG. 6 is a view illustrating a light distribution pattern formed when all the light sources of the lamp for a vehicle according to the present disclosure are turned on.

DETAILED DESCRIPTION

Hereinafter, a lamp for a vehicle and a vehicle according to the present disclosure will be described with reference to the drawings.

Lamp for Vehicle

Figure 1:
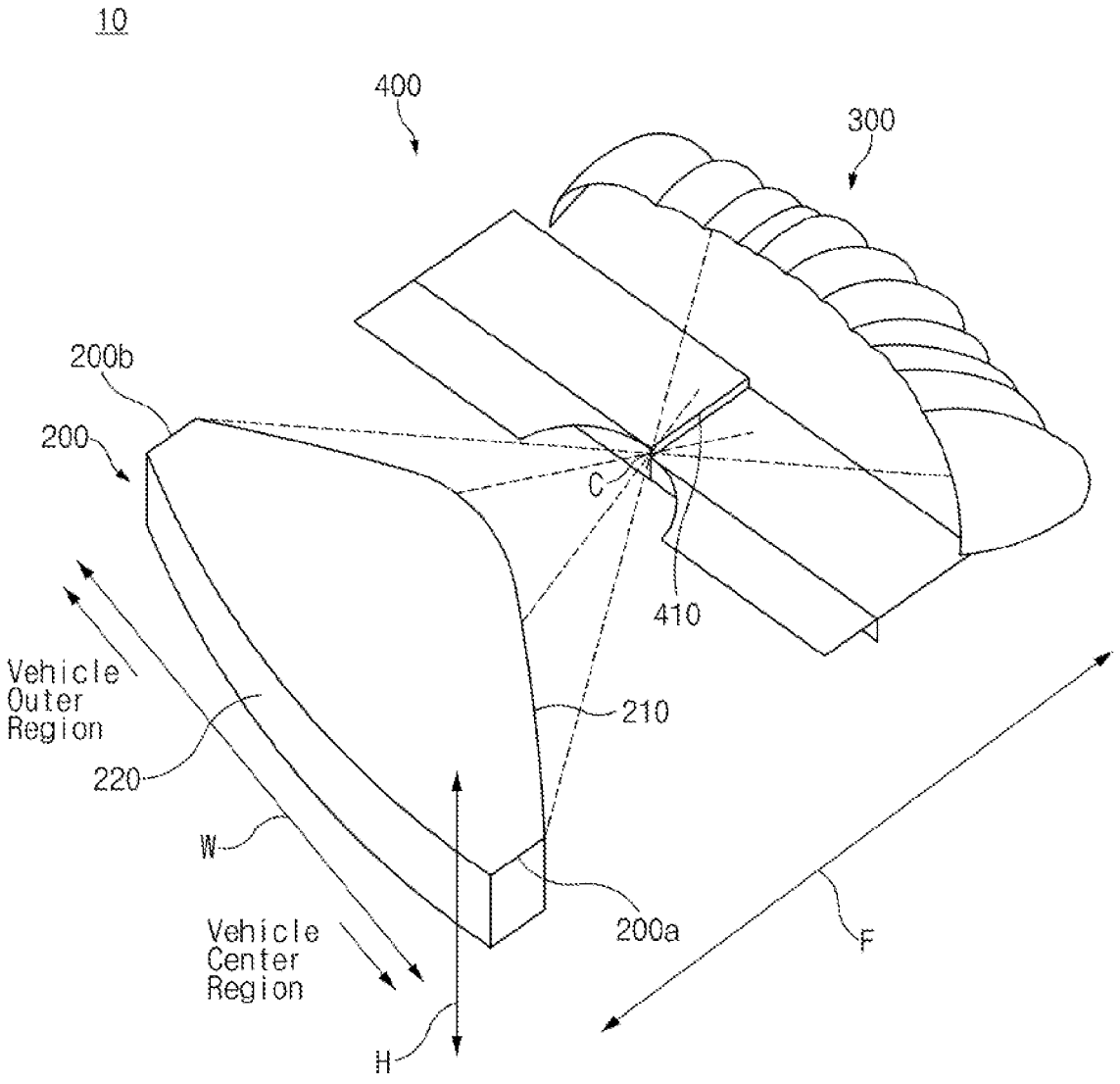
FIG. 1 is a perspective view illustrating a structure of a lamp for a vehicle according to the present disclosure.
Figure 2:
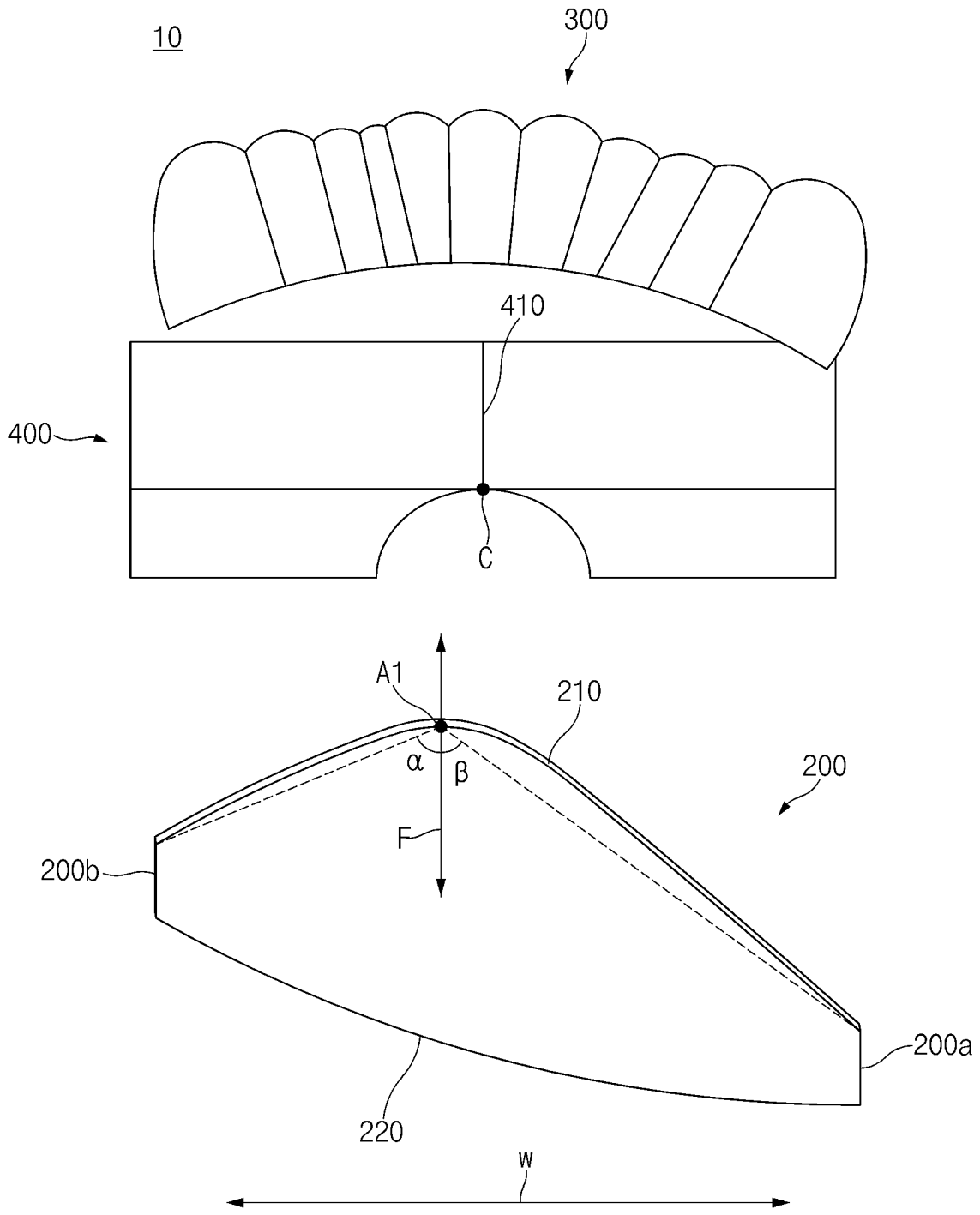
FIG. 2 is a top plan view illustrating the structure of the lamp for a vehicle according to the present disclosure.
Figure 3:
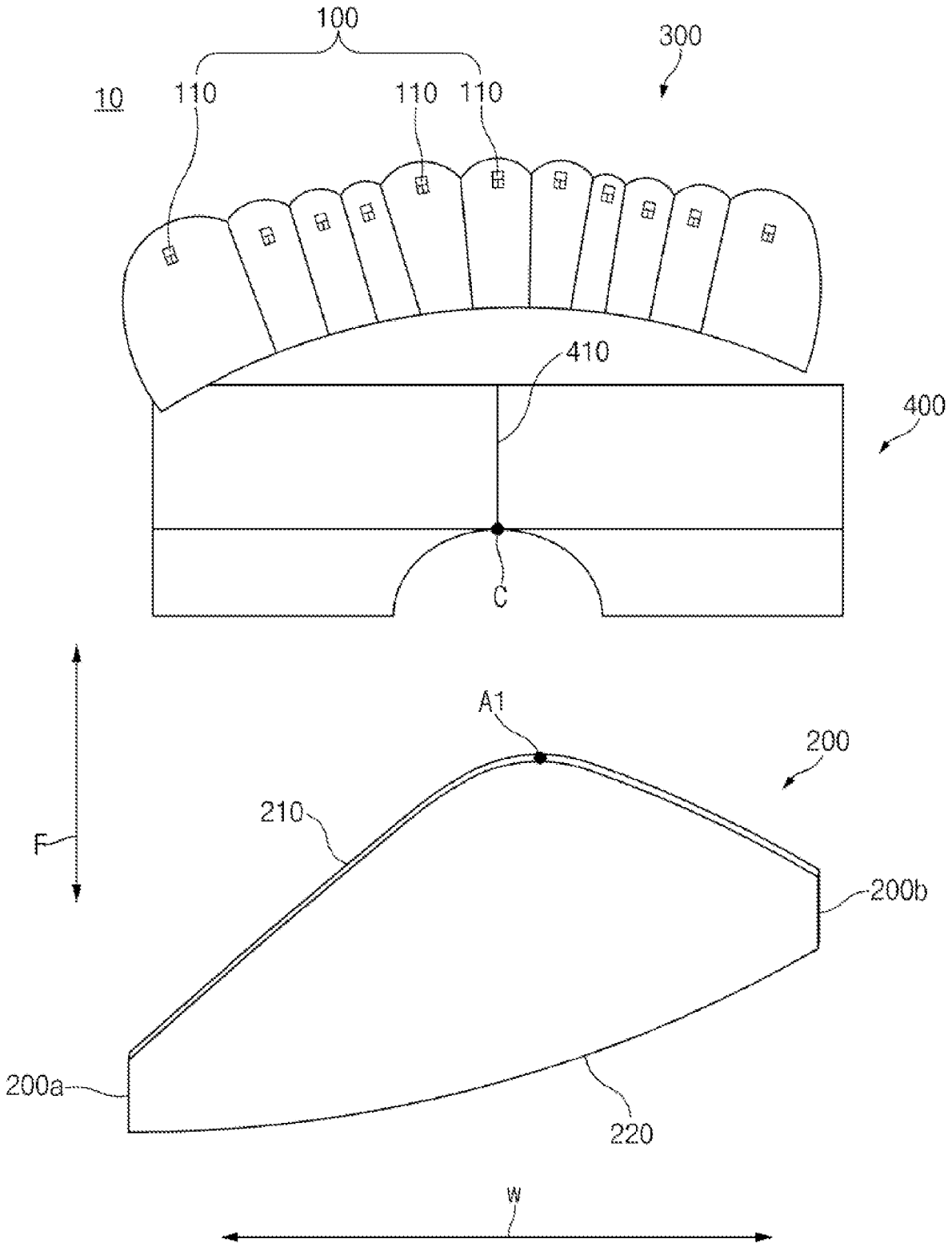
FIG. 3 is a bottom plan view illustrating the structure of the lamp for a vehicle according to the present disclosure.

FIG. 1 is a perspective view illustrating a structure of a lamp for a vehicle according to the present disclosure, and FIG. 2 is a top plan view illustrating the structure of the lamp for a vehicle according to the present disclosure. FIG. 3 is a bottom plan view illustrating the structure of the lamp for a vehicle according to the present disclosure.

A lamp 10 for a vehicle (hereinafter, referred to as a 'lamp') according to the present disclosure may be a lamp for forming a low-beam light distribution pattern.

More specifically, the lamp 10 may include a light source unit 100 including a plurality of light sources 110 configured to emit light, and an inner lens 200 configured to receive the light emitted from the light source unit 100 and allow the received light to enter the inner lens 200.

The inner lens 200 may refract the light, which is emitted from the light source unit and then enters the inner lens 200, and allow the refracted light to exit to the outside, thereby forming a predetermined low-beam light distribution pattern. In particular, according to the present disclosure, a surface of the inner lens 200 may have a continuous shape and form the low-beam light distribution pattern. Therefore, it is possible to remove interruptions existing in a particular region of the low-beam light distribution pattern. The features of the inner lens 200 for achieving the above-mentioned configuration will be described below.

The inner lens 200 according to the present disclosure may have a single integrated body. In addition, the inner lens 200 may include a light entering surface 210 disposed at and/or define a rear surface of the inner lens 200 and allow the light emitted from the light source unit 100 to enter the light entering surface 210, and a light exiting surface 220 disposed at and/or define a front surface of the inner lens 200 and allow the light entering the light entering surface 210 to exit the light exiting surface 220. As illustrated in the drawings, the light entering surface 210 of the inner lens 200 may have a convex shape bulging rearwardly, and the light exiting surface 220 of the inner lens 200 may have a convex shape bulging forward.

In this case, according to the present disclosure, the light exiting surface 220 of the inner lens 200 may have a shape asymmetric in a lateral (leftward/rightward) direction W. More specifically, the light exiting surface 220 of the inner lens 200 may have a curved shape longitudinally extending in a lateral direction between two lateral end portions of the inner lens 200 and curved inwardly from one of the two lateral end portions to the other. For example, the light exiting surface 220 may be curved so that positions on the light exiting surface 220 from one side end (i.e., first lateral end portion) 200*a* to the other side end (i.e., second lateral end portion) 200*b* opposite to one side end 200*a* based on the leftward/rightward direction W of the lamp 10 become closer to the rear side of the vehicle. As described below, when the lamp 10 according to the present disclosure is mounted in the vehicle, one side end 200*a* based on the leftward/rightward direction W may be disposed adjacent to a central region of the vehicle, and the other side end 200*b* based on the leftward/rightward direction W may be disposed adjacent to an outer region of the vehicle.

In addition, according to the present disclosure, the light entering surface 210 of the inner lens 200 may also have a laterally asymmetric shape asymmetric in the leftward/rightward direction W. For example, in the light entering surface 210 of the inner lens 200, a region positioned at one side end 200*a* based on the leftward/rightward direction W may be closer to the front side of the vehicle than is a region positioned at the other side end 200*b* based on the leftward/rightward direction W.

More specifically, as illustrated in the drawings, according to the present disclosure, an angle β defined between a forward/rearward direction F of the lamp 10 and an imaginary line connecting a vertex region A1 positioned at a rearmost side of the light entering surface 210 of the inner lens 200 and a region of the light entering surface 210 positioned at one side end 200*a* may be larger than an angle α defined between the forward/rearward direction F and an imaginary line connecting the vertex region A1 of the light entering surface 210 and a region of the light entering surface 210 positioned at the other side end 200*b*. More particularly, the vertex region A1 of the inner lens 200 may be spaced apart from a focal point C of the inner lens 200 toward the other side end 200*b* based on the leftward/rightward direction W. Meanwhile, a focal point of the inner lens 200 based on the leftward/rightward direction W and a focal point of the inner lens 200 based on an upward/downward direction H may be identical to each other.

Meanwhile, as described above, the light source unit 100 may include the plurality of light sources 110. In this case, among the plurality of light sources 110, an interval between the two adjacent light sources 110 may vary depending on respective regions.

More specifically, referring to the drawings, an interval between the plurality of light sources 110 disposed adjacent to one side end 200*a* of the inner lens 200 based on the leftward/rightward direction W among the plurality of light sources 110 of the light source unit 100 may be larger than an interval between the plurality of light sources 110 disposed adjacent to the other side end 200*b* of the inner lens 200 based on the leftward/rightward direction W among the plurality of light sources 110 of the light source unit 100.

In addition, according to the present disclosure, among the plurality of light sources 110 of the light source unit 100, the sizes of light-emitting surfaces of some light sources may be different from those of the other light sources.

More specifically, according to the present disclosure, the light-emitting surface of the light source 110 provided in the central region of the inner lens 200 based on the leftward/rightward direction W among the plurality of light sources 110 of the light source unit 100 may be smaller than the light-emitting surface of the light source 110 provided in the peripheral region of the inner lens 200 based on the leftward/rightward direction W among the plurality of light sources 110 of the light source unit 100.

Referring to the drawings, the lamp 10 according to the present disclosure may further include a reflector 300 provided at one side of the light source unit 100 and configured to reflect the light emitted from the light source unit 100 and allow the light to propagate toward the inner lens 200.

In this case, according to the present disclosure, distances between the reflector 300 and the plurality of light sources 110 of the light source unit 100 may be different from one another for respective regions.

More specifically, a shortest distance between a rear region of the reflector 300 and the light source 110 provided in the central region of the inner lens 200 based on the leftward/rightward direction W among the plurality of light sources 110 of the light source unit 100 may be shorter than a shortest distance between the rear region of the reflector 300 and the light source 110 provided in the peripheral region of the inner lens 200 based on the leftward/rightward direction W among the plurality of light sources 110 of the light source unit 100.

Referring to the drawings, the lamp 10 according to the present disclosure may further include a shield 400 disposed between the light source unit 100 and the inner lens 200 and having a cut-off portion 410 having a stepped shape. In this case, the focal point C of the inner lens 200 may be formed at a position corresponding to a front end of the shield 400.

Figure 4:
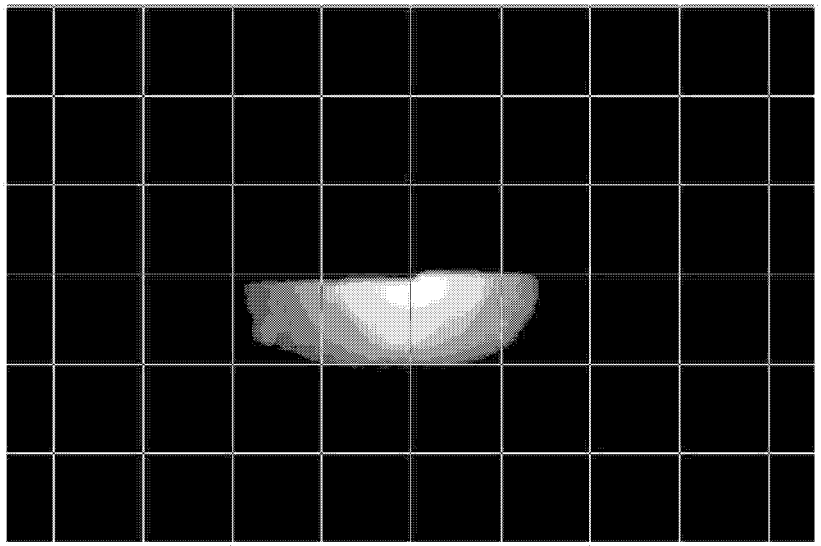
Figure 5:
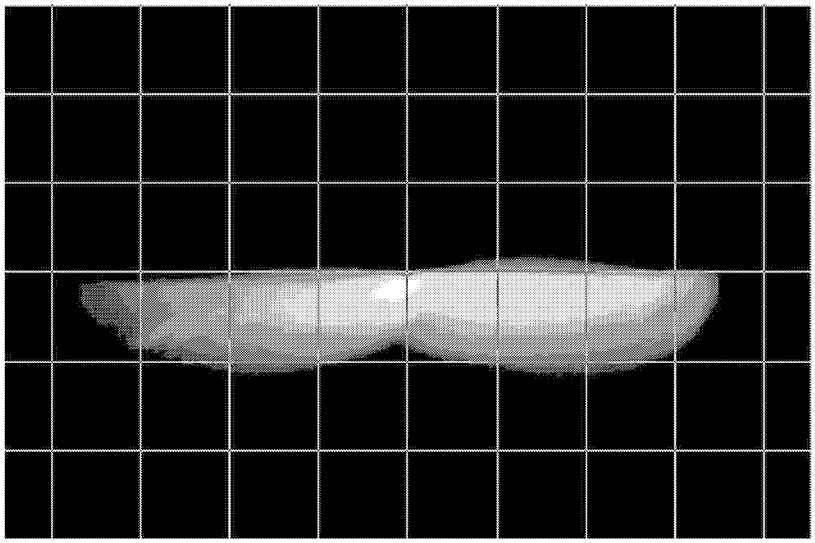
Figure 6:
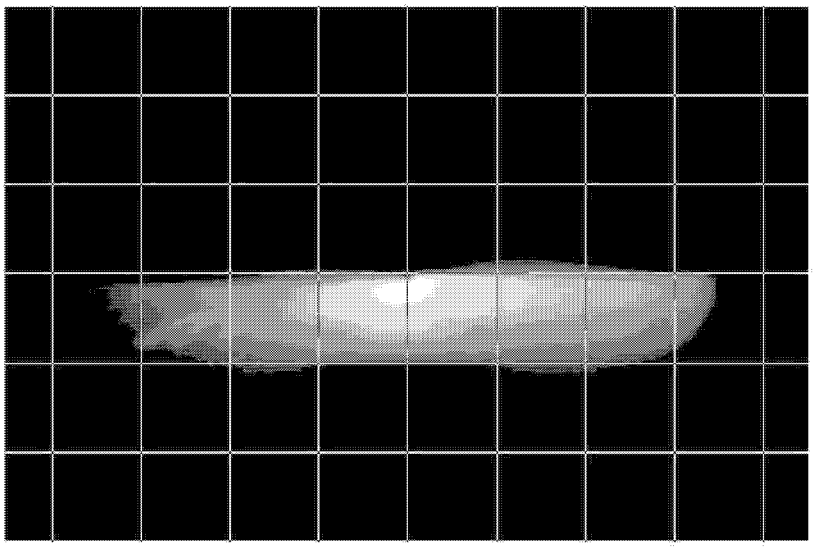

FIG. 4 is a view illustrating a light distribution pattern formed when the light sources provided in the central region of the lamp for a vehicle according to the present disclosure based on the leftward/rightward direction are turned on, and FIG. 5 is a view illustrating a light distribution pattern formed when the light sources provided in the peripheral region of the lamp for a vehicle according to the present disclosure based on the leftward/rightward direction are turned on. FIG. 6 is a view illustrating a light distribution pattern formed when all the light sources of the lamp for a vehicle according to the present disclosure are turned on.

Referring to the above-mentioned description, the light entering surface 210 and the light exiting surface 220 of the inner lens 200 of the lamp 10 according to the present disclosure each have a continuous shape. Therefore, as illustrated in FIGS. 4 to 6, when some or all the plurality of light sources 110 of the light source unit 100 are turned on, a light distribution pattern having a continuous change in luminous intensity may be implemented.

Vehicle

A vehicle according to the present disclosure may include the lamp 10 for a vehicle.

In this case, the lamp 10 may include the light source unit 100 including the plurality of light sources 110 configured to emit light, and the inner lens 200 configured to allow the light emitted from the light source unit 100 to enter the inner lens 200. In addition, the inner lens 200 may include the light entering surface 210 configured to define the rear surface of the inner lens 200 and allow the light emitted from the light source unit 100 to enter the light entering surface 210, and the light exiting surface 220 configured to define the front surface of the inner lens 200 and allow the light entering the light entering surface 210 to exit the light exiting surface 220. In addition, the light exiting surface 220 may have a curved shape curved so that positions on the light exiting surface 220 from one side end 200*a* to the other side end 200*b* opposite to one side end 200*a* based on the leftward/rightward direction W of the lamp 10 become closer to the rear side of the vehicle.

More specifically, one side end 200*a* based on the leftward/rightward direction W may be disposed adjacent to the central region of the vehicle, and the other side end 200*b* based on the leftward/rightward direction W may be disposed adjacent to the outer region of the vehicle.

Meanwhile, the above-mentioned description of the lamp for a vehicle according to the present disclosure may also be equally applied to the lamp provided in the vehicle according to the present disclosure.

The present disclosure has been described with reference to the limited embodiments and the drawings, but the present disclosure is not limited thereto. The present disclosure may be carried out in various forms by those skilled in the art, to which the present disclosure pertains, within the technical spirit of the present disclosure and the scope equivalent to the appended claims.

What is claimed is:

1. A lamp for a vehicle, comprising:

a light source unit comprising a plurality of light sources configured to emit light; and a lens configured to receive the light emitted from the light source unit, wherein the lens comprises:

a light entering surface disposed at a rear surface of the lens and configured to receive the light emitted from the light source unit; and a light exiting surface disposed at a front surface of the lens and configured to externally transmit the light received by the light entering surface, wherein the light exiting surface has a curved shape extending longitudinally in a lateral direction between first and second lateral end portions of the lens and curved inwardly from the first lateral end portion to the second lateral end portion, and wherein a first angle between (1) a forward/rearward direction of the lens and (2) a first imaginary line connecting a vertex region positioned at a rearmost side of the light entering surface and a first region of the light entering surface positioned at the first lateral end portion is larger than a second angle between (1)

the forward/rearward direction and (2) a second imaginary line connecting the vertex region and a second region of the light entering surface positioned at the second lateral end portion.

2. The lamp of claim 1, wherein the light entering surface has a laterally asymmetric shape.

3. The lamp of claim 1, wherein a lateral focal point of the lens corresponds to a vertical focal point of the lens.

4. The lamp of claim 1, wherein the vertex region of the lens is laterally spaced apart from a focal point of the lens and positioned closer to the second lateral end portion than to the first lateral end portion.

5. The lamp of claim 1, further comprising a reflector disposed at a side of the light source unit and configured to reflect the light emitted from the light source unit and allow the light to propagate toward the lens, wherein a shortest distance between a rear region of the reflector and the light source positioned at a first region corresponding to a lateral center region of the lens is shorter than that between the rear region of the reflector and the light source positioned at a second region corresponding to a peripheral region of the lens.

6. The lamp of claim 1, wherein a region of the light entering surface positioned at the first lateral end portion of the lens is closer to a front side of the lens of the lens than that of the light entering surface positioned at the second lateral end portion is to the front side.

7. The lamp of claim 1, wherein the light entering surface has a convex shape bulging rearwardly, and the light exiting surface has a convex shape bulging forward.

8. The lamp of claim 1, further comprising a shield disposed between the light source unit and the lens and having a cut-off portion having a stepped shape, wherein a focal point of the lens is positioned corresponding to a front end of the shield.

9. A vehicle comprising the lamp of claim 1.

10. The vehicle of claim 9, wherein a first lateral end portion of the lamp is disposed adjacent to a central region of the vehicle, and a second lateral end portion of the lamp is disposed adjacent to an outer region of the vehicle.

11. A lamp for a vehicle, comprising:

a light source unit comprising a plurality of light sources configured to emit light; and a lens configured to receive the light emitted from the light source unit, wherein the lens comprises:

a light entering surface disposed at a rear surface of the lens and configured to receive the light emitted from the light source unit; and a light exiting surface disposed at a front surface of the lens and configured to externally transmit the light received by the light entering surface, wherein the light exiting surface has a curved shape extending longitudinally in a lateral direction between first and second lateral end portions of the lens and curved inwardly from the first lateral end portion to the second lateral end portion, and wherein an interval between the light sources disposed adjacent to the first lateral end portion is larger than that between the light sources disposed adjacent to the second lateral end portion.

12. A vehicle comprising the lamp of claim 11.

13. A lamp for a vehicle, comprising:

a light source unit comprising a plurality of light sources configured to emit light; and a lens configured to receive the light emitted from the light source unit, wherein the lens comprises:

a light entering surface disposed at a rear surface of the lens and configured to receive the light emitted from the light source unit; and a light exiting surface disposed at a front surface of the lens and configured to externally transmit the light received by the light entering surface, wherein the light exiting surface has a curved shape extending longitudinally in a lateral direction between first and second lateral end portions of the lens and curved inwardly from the first lateral end portion to the second lateral end portion, and wherein a light-emitting surface of the light source positioned at a first region corresponding to a lateral center region of the lens is smaller than that of the light source positioned at a second region corresponding to a peripheral region of the lens.

14. A vehicle comprising the lamp of claim 13.

* * * * *